US008548364B2

(12) United States Patent
Oba et al.

(10) Patent No.: US 8,548,364 B2
(45) Date of Patent: Oct. 1, 2013

(54) DEVELOPING DEVICE AND IMAGE-FORMING APPARATUS

(75) Inventors: Shota Oba, Ebina (JP); Shigeru Inaba, Ebina (JP); Takashi Yamamuro, Kawasaki (JP); Takashi Ochi, Ebina (JP); Shinichi Kuramoto, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 428 days.

(21) Appl. No.: 12/729,010

(22) Filed: Mar. 22, 2010

(65) Prior Publication Data

US 2011/0069999 A1 Mar. 24, 2011

(30) Foreign Application Priority Data

Sep. 24, 2009 (JP) ..... 2009-219409

(51) Int. Cl.
*G03G 15/08* (2006.01)

(52) U.S. Cl.
USPC ..... 399/286; 399/270; 399/276; 492/36

(58) Field of Classification Search
USPC ..... 399/270, 276, 286; 492/36
See application file for complete search history.

(56) References Cited

U.S. PATENT DOCUMENTS

| | | | | |
|---|---|---|---|---|
| 4,018,187 | A | 4/1977 | Abbott | |
| 4,634,259 | A * | 1/1987 | Oishi et al. | 399/171 |
| 6,560,432 | B1 * | 5/2003 | Longhenry et al. | 399/286 |
| 6,925,277 | B2 * | 8/2005 | Sugihara | 399/276 |

FOREIGN PATENT DOCUMENTS

| | | | |
|---|---|---|---|
| JP | 61-30271 | A | 1/1978 |
| JP | 2004-21043 | A | 1/2004 |

* cited by examiner

*Primary Examiner* — Walter L Lindsay, Jr.
*Assistant Examiner* — Benjamin Schmitt
(74) *Attorney, Agent, or Firm* — Sughrue Mion, PLLC

(57) ABSTRACT

A developing device includes: an magnetic field generating unit that generates an magnetic field; and a cylindrical developer holder, to which a voltage is applied, that surrounds the magnetic field generating unit and rotates, the cylindrical developer holder: having an outer circumferential surface having a plurality of grooves that extend in a direction of a rotational axis, the outer circumferential surface being capable of holding developer including a magnetic substance by using the magnetic field generated by the magnetic field generation unit, an electrical resistance of an inner wall surface of each of the grooves being higher than an electrical resistance of the magnetic substance included in the developer; and supplying the developer to an image holder that holds an electrostatic latent image.

17 Claims, 3 Drawing Sheets

*FIG. 4*
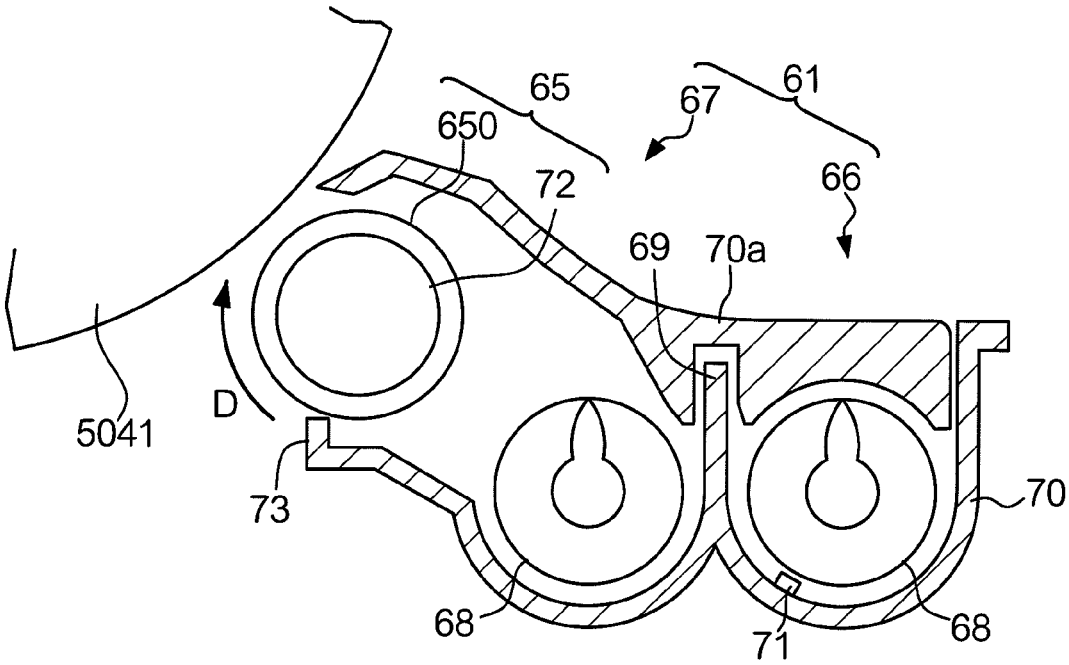
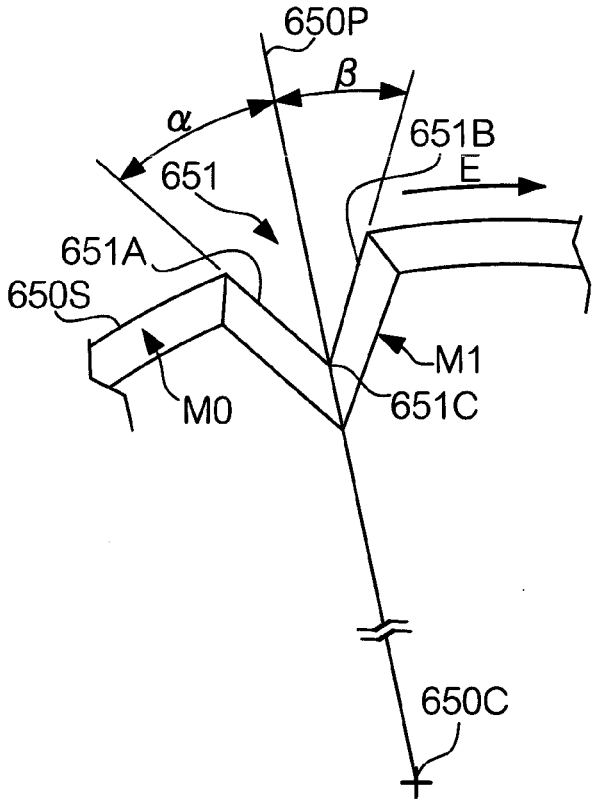
*FIG. 5*

DEVELOPING DEVICE AND IMAGE-FORMING APPARATUS

CROSS-REFERENCE TO RELATED APPLICATIONS

This application is based on and claims priority under 35 USC 119 from Japanese Patent Application No. 2009-219409 filed on Sep. 24, 2009.

BACKGROUND

1. Technical Field

The present invention relates to a developing device and an image-forming apparatus.

2. Related Art

Electrophotographic image-forming devices are constituted generally to include a developing sleeve that functions as a developer holder. Such a developer generally is a two-component developer containing a magnetic carrier and a toner. Upon application of the magnetic force supplied from a magnetic roller to the developer held on the developing sleeve, the magnetic carrier in the developer is caused to align in a direction of the magnetic force applied, and to bunch together in bundles that assume a vertical stance. Such a bunch of developer is referred to as magnetic brush. Upon rotation of the developing sleeve the magnetic brushes contact an image holder such as a photosensitive drum and upon contact supply a toner from the developing sleeve to the image holder.

SUMMARY

According to an aspect of the invention, there is provided a developing device including: an magnetic field generating unit that generates an magnetic field; and a cylindrical developer holder, to which a voltage is applied, that surrounds the magnetic field generating unit and rotates, the cylindrical developer holder: having an outer circumferential surface having a plurality of grooves that extend in a direction of a rotational axis, the outer circumferential surface being capable of holding developer including a magnetic substance by using the magnetic field generated by the magnetic field generation unit, an electrical resistance of an inner wall surface of each of the grooves being higher than an electrical resistance of the magnetic substance included in the developer; and supplying the developer to an image holder that holds an electrostatic latent image.

BRIEF DESCRIPTION OF THE DRAWINGS

Exemplary embodiment of the present invention will be described in detail based on the following figures, wherein:

FIG. 4 is a schematic diagram showing an internal configuration of a developing device provided for colors;

FIG. 5 is an enlarged diagram showing a developing sleeve; and

DETAILED DESCRIPTION

Following is a description of an exemplary embodiment of the present invention. Here, an electrophotographic printer (image-forming apparatus) including a so-called tandem engine, in which an intermediate transfer belt and plural image holders are arranged in tandem, is described as an example of the exemplary embodiment of the present invention. However, the present invention is not limited to this aspect.

1. Configuration (1) Overall Configuration of Image-Forming Apparatus

Figure 1:
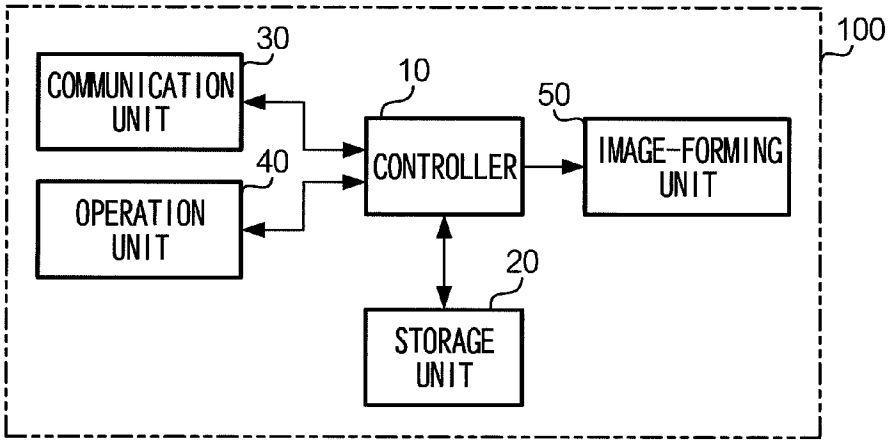
FIG. 1 is a schematic diagram showing an overall configuration of an image-forming apparatus according to an exemplary embodiment of the present invention.

FIG. 1 is a schematic diagram showing an overall configuration of image-forming apparatus 100 according to an exemplary embodiment of the present invention. As shown in FIG. 1, image-forming apparatus 100 includes controller 10, storage unit 20, communication unit 30, operation unit 40, and image-forming unit 50.

Controller 10 is an arithmetic unit including a Central Processing Unit (CPU), Random Access Memory (RAM), Read Only Memory (ROM), and so on (which are not shown). Controller 10 controls an operation of each part of image-forming apparatus 100 by reading into the RAM programs (information) stored in the ROM and executing the programs.

Storage unit 20 is a storage device such as a Hard Disk Drive (HDD), and stores various data used for image forming, such as image data for expressing an image.

Communication unit 30 is an interface device for exchanging image data with external devices such as a digital camera, a personal computer, and a scanner.

Operation unit 40 is an input device including a touch panel, and displays various information relating to image forming, and upon receipt of a user instruction the operation unit outputs instruction information.

Image-forming unit 50 forms on a sheet-shaped recording medium an image from image data inputted via communication unit 30. The recording medium may be what is referred to generally as plain paper, or a paper having a coated surface, the coating being a resin or the like, or a recording medium made from a material other than paper. Image-forming unit 50 specifically includes a configuration as described below.

(2) Configuration of Image-Forming Unit

Figure 2:
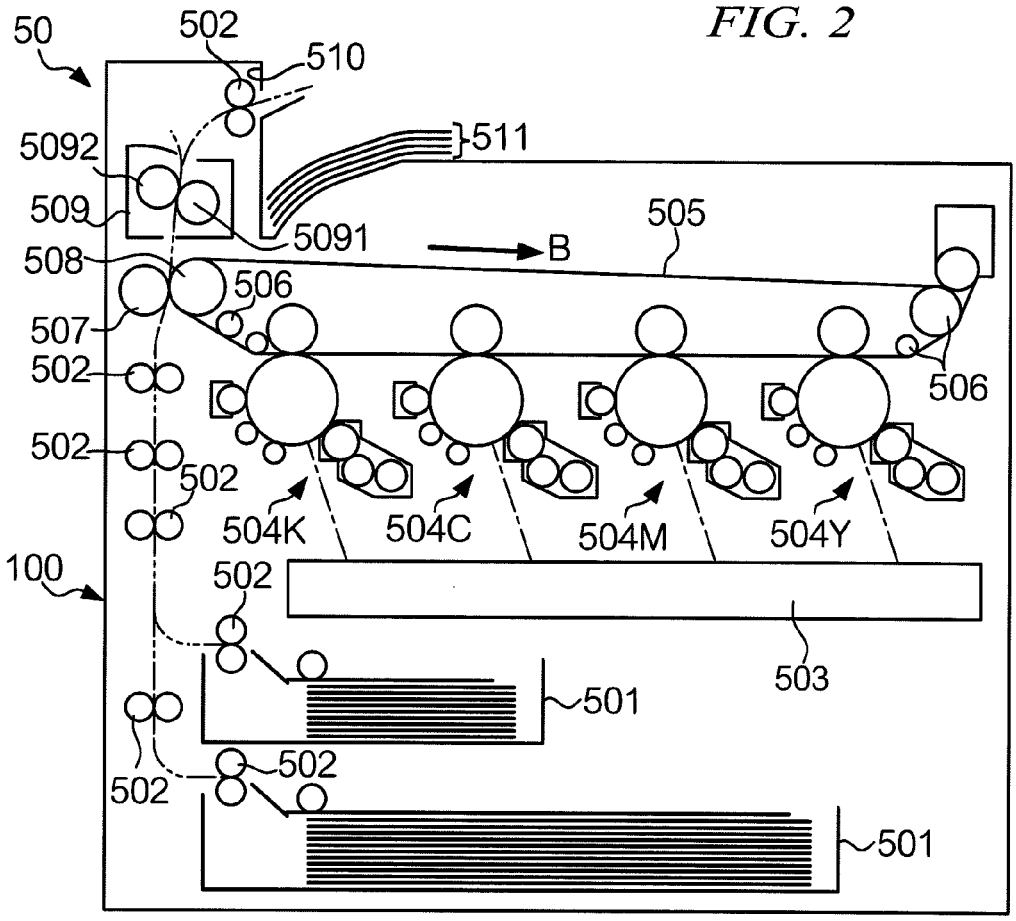
FIG. 2 is a diagram showing a configuration of an image-forming unit.

FIG. 2 is a diagram showing a configuration of image-forming unit 50. It is noted that each dash-dot-dot line of FIG. 2 indicates a path of a recording medium. Image-forming unit 50 includes plural paper feed trays 501, plural paper carrying rollers 502, exposure device 503, transfer units 504Y, 504M, 504C, and 504K, intermediate transfer belt 505, plural belt rollers 506, second transfer roller 507, fixing device 509, output aperture 510, and paper-receiving output tray 511.

Each of paper feed trays 501 stores a recording medium of a predetermined type and size, and supplies the recording medium at a timing instructed by controller 10. Paper carrying rollers 502 carry a recording medium supplied from paper feed tray 501 to a nip area formed between second transfer roller 507 and backup roller 508. Exposure device 503 includes laser illuminants, polygon mirrors and so on (which are not shown), and irradiates a laser light corresponding to image data to transfer units 504Y, 504M, 504C, 504K.

Transfer units 504Y, 504M, 504C, 504K respectively form images using color toner in yellow (Y), magenta (M), cyan (C), black (K), and transfer the images onto intermediate transfer belt 505. Transfer units 504Y, 504M, 504C, 504K differ from each other in their use of toner, but there is no significant difference between those configurations. For ease of explanation and in view of the art, when no particular distinction is made between units 504Y, 504M, 504C, 504K, and suffixed letters indicating each of a toner color are omitted, with transfer units 504Y, 504M, 504C, 504K being collectively referred to as "transfer unit 504." Details of transfer unit 540 will be described later.

Intermediate transfer belt 505 is an endless belt member, and is held in a tensioned state by belt rollers 506. At least one of belt rollers 506 includes a drive unit (not shown), and moves intermediate transfer belt 505 in a direction indicated by arrow B in FIG. 2. It is to be noted that each of belt rollers 506 that does not include the drive unit (not shown) rotate under movement of intermediate transfer belt 505. Intermediate transfer belt 505 moves an image transferred by transfer unit 504 to a nip area formed between second transfer roller 507 and backup roller 508, by rotating and moving in the direction indicated by arrow B in FIG. 2.

A predetermined electrical potential difference is generated between second transfer roller 507 and backup roller 508, whereby second transfer roller 507 and backup roller 508 transfer an image onto a recording medium at a position where intermediate transfer belt 505 faces the recording medium. Fixing device 509 includes heating roller 5091 and pressure roller 5092, and fixes the transferred image on a recording medium by applying, by way of the rollers, heat and pressure to the recording medium. The image fixing recording medium is carried to output aperture 510 by paper carrying rollers 502, and is outputted and stacked on paper-receiving output tray 511.

(3) Configuration of Transfer Unit

Figure 3:
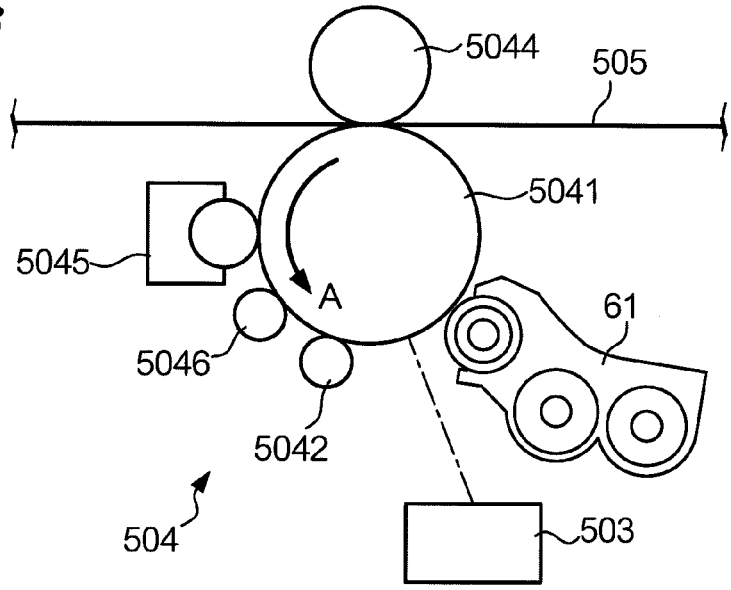
FIG. 3 is a diagram showing a configuration of a transfer unit.

FIG. 3 is a diagram showing a configuration of transfer unit 504. As shown in FIG. 3, transfer unit 504 includes photosensitive drum 5041, roller-type charging device 5042, developing device 61, primary transfer roller 5044, drum cleaner 5045, and charge erasing device 5046. Photosensitive drum 5041 is an image holder having a charge generation layer and a charge transfer layer. Photosensitive drum 5041 is caused to rotate in the direction indicated by arrow A of FIG. 3 by a drive unit (not shown). Roller-type charging device 5042 charges the surface of the photosensitive drum 5041. Exposure device 503 exposures a part of the surface of photosensitive drum 5041 on the basis of image data retrieved from storage unit 20, under control of controller 10. Consequently, an electric charge in the exposed part changes, and a latent image is formed on the surface of photosensitive drum 5041. The electric charge in the exposed part is positive, and is greater than that in any other part. Developing device 61 stores a two-component developer that consists of a toner in any of colors Y, M, C, K, and a magnetic carrier such as a ferrite powder.

FIG. 4 is a schematic diagram showing an internal configuration of developing device 61 provided for colors. Each of developing devices 61 includes: developing roller 65, screw 68, which functions as a an agitating member for a developer and a carrying member for the developer; developer doctor 73, which functions as a developer adjuster, and development casing 70, development cover 70*a*, and so on.

Each of developing devices 61 uses a two-component developer (hereinafter referred to as "developer") including a carrier that is a magnetic substance, and a toner that is a non-magnetic substance. Each of developing devices 61 consists of agitating unit 66 and developing unit 67. Agitating unit 66 carries developer while agitating the developer, and supplies and attaches the developer to developing roller 65. Developing unit 67 moves toner of developer held on developing roller 65 to photosensitive drum 5041, and performs development. Agitating unit 66 is located at a lower part of developing unit 67. In agitating unit 66, a pair of parallel screw members 68 is provided. A space between screw members 68 is partitioned by partition board 69 with the ends of the screw members 68 remaining open. To development casing 70, toner density sensor 71 is attached.

In developing unit 67, developing roller 65 is provided to face photosensitive drum 5041 across an opening of development casing 70. Developing roller 65 includes magnet roller 72, which functions as a magnetic field generating unit for generating a magnetic field, and developing sleeve 650, which functions as a developer holder. Magnet roller 72 is fixed on the inside of developing sleeve 650, and forms plural magnetic poles at predetermined positions and angles in an axial direction. A force of magnetic field thus generated acts on developer held on developing sleeve 650 during passage of the developer through respective magnetic poles formed at predetermined positions corresponding to magnetic poles of magnet roller 72.

Developing sleeve 650 is a cylindrical developer holder, which is a non-magnetic sleeve that is provided so as to cover the outer circumferential surface of magnet roller 72 and rotate with the roller, and to which a voltage is applied. When developing sleeve 650 is rotated by a drive unit (not shown) in the direction indicated by arrow D of FIG. 4 (hereinafter referred to as "developer carrying direction"), developer to which a magnetic force is imparted by magnet roller 72 is carried. At an upstream side along a developer carrying direction, an area that acts as a holding part for developer residuals is formed due to an arrangement of magnetic poles of magnet roller 72 and under an action of the developer adjuster (a developer doctor). The developer residual holding area promotes friction charging of developer. Near the end of the developer adjuster, a magnetic substance is provided to make uniform a direction of a magnetic force facing the developing roller, and thereby reduce variability in an amount of developer that is carried Two screws 68 circulate and carry developer while agitating, and supply the developer to developing sleeve 650. The supplied developer aligns in a direction of the acting magnetic force imparted from magnet roller 72 and bunches together in bundles to form magnetic brushes. A magnetic brush thus formed is held on developing sleeve 650, and under rotation of developing sleeve 650 is moved to a position where developer doctor 73 is provided. The end of the magnetic brush is then cut by developer doctor 73 to adjust its amount to one that is appropriate. Here, the term "appropriate amount" refers to a predetermined amount such that developer is in a dense state when the developer is located between developing sleeve 650 and photosensitive drum 5041. Developer from end that is cut is returned to agitating unit 66.

A predetermined developing bias voltage is applied to developing sleeve 650 from a power supply (not shown). The developing bias voltage is, for example, a DC voltage of −600 V on which an AC voltage having a frequency of 1 kHz, an AC component amplitude of 1.0 kV and a duty ratio of 70% is superimposed.

Toner of developer on developing sleeve 650 develops a negative charge due to the developing bias voltage applied to developing sleeve 650. The toner moves to the exposed part of photosensitive drum 5041, where it is charged positively, and develops a latent image on photosensitive drum 5041. After development, developer remaining on developing sleeve 650 is separated from developing sleeve 650 at a position where a magnetic force of magnet roller 72 is lower than at other positions, and the developer is returned to agitating unit 66. By repetition of this operation, a density of toner in agitating unit 66 is caused to decrease. This decrease in toner density is detected by toner density sensor 71, and toner is replenished to agitating unit 66. In other words, developing sleeve 650 is an example of a cylindrical developer holder that surrounds an electric generating unit and rotates, with a voltage being applied thereto, and has an outer circumferential surface containing plural grooves that extend along a direction of an axis of rotation, such that the outer circumferential surface is capable of holding developer, and of supplying the developer thus held to an image holder that holds an electrostatic latent image.

Referring once more to FIG. 3, further description is now given. Primary transfer roller 5044 generates a predetermined electrical potential difference at a position where intermediate transfer belt 505 and photosensitive drum 5041 face each other, and transfers an image onto intermediate transfer belt 505 under utilization of the electrical potential difference. Drum cleaner 5045 removes untransferred toner remaining on the surface of photosensitive drum 5041 after completion of image transfer. Charge erasing device 5046 erases a charge on the surface of photosensitive drum 5041. In other words, drum cleaner 5045 and charge erasing device 5046 removes unnecessary toner or electricity from photosensitive drum 5041 in preparation for a subsequent image forming operation.

It is to be noted here that a diameter of photosensitive drum 5041 is 30 mm, a surface speed of photosensitive drum 5041 (hereinafter referred as "drum surface speed") is 240 mm/s, a diameter of developing sleeve 650 is 18 mm, a surface speed of developing sleeve 650 (hereinafter referred to as "sleeve surface speed") is 600 mm/s, and a shortest distance between photosensitive drum 5041 and developing sleeve 650 (hereinafter referred to as "developing gap") is 0.4 mm.

(4) Configuration of Development Sleeve

FIG. 5 is a cross-sectional diagram showing an enlarged near surface of developing sleeve 650. As shown in FIG. 5, on the surface of developing sleeve 650, there are provided V-shaped grooves 651 as viewed in cross section. An inner wall surface of each of grooves 651 located at an upstream side along a direction of movement of a surface of the developing sleeve (a direction indicated by arrow E in FIG. 5) refers to upstream inner wall surface 651A. An inner wall surface located at a downstream side along a direction of movement of the surface of the developing sleeve refers to downstream inner wall surface 651B. Upstream inner wall surface 651A and virtual surface 650P, which is perpendicular to the direction of movement of the surface of the developing sleeve and passes bottom 651C of groove 651, forms an angle of inclination alpha. The angle of inclination alpha is greater than or equal to 45 degrees and smaller than or equal to 60 degrees.

Downstream inner wall surface 651B and virtual surface 650P together form an angle of inclination beta. Angle of inclination beta is greater than or equal to 0 degree. It is to be noted here that if developing sleeve 650 is a cylindrical member, virtual surface 650P also refers to a virtual surface connecting bottom 651C of groove 651 and central axis 650C of developing sleeve 650. In addition, a depth of groove 651 is 0.1 mm, thus bottom 651C is closer to central axis 650C of developing sleeve 650 by 0.1 mm than outer circumferential surface 650S, which is a surface other than that of groove 651.

Outer circumferential surface 650S is a part closest to the outer circumferential surface of photosensitive drum 5041. In a developing nip (developing area), friction occurs due to a developer being in a packing state. Thus, the outer circumferential surface 650S of developing sleeve 650 can be abraded readily. Accordingly, it is preferred that a level of coarseness of outer circumferential surface 650S, which is a surface other than that of groove 651, is smaller than or equal to 0.5 micrometer, as measured relative to an average level of coarseness Ra as defined in Japanese Industrial Standards (JIS) B0601; and more preferably is smaller than or equal to 0.3 micrometer; and further still more preferably is smaller than or equal to 0.05 micrometer. In a case where a level of coarseness is set as above, a deterioration or variation over time of an efficiency of conveyance can be avoided since an occurrence of friction between outer circumferential surface 650S of developing sleeve 650. It is noted that each of upstream inner wall surface 651A and downstream inner wall surface 651B has a particular angle relative to the outer circumferential surface of photosensitive drum 5041, whereby friction that would otherwise be generated as a result of a packing state does not occur and abrasion of the surface is largely avoided.

A material of an inner wall surface of each groove 651 (hereinafter referred to as material M1) differs from a material of an outer circumferential surface 650S (hereinafter referred to as material M0). The materials are selected such that an electrical resistance of material M0 is lower than that of a carrier of developer, and an electrical resistance of material M1 is higher than that of an electrical resistance of the carrier of developer. In other words, an electrical resistance of the surface of the groove is higher than an electrical resistance of carrier included in developer. It is to be noted here that an electrical resistance of carrier is smaller than or equal to $10^8$ ohm. Measurement of resistance is carried out by the method explained below.

First, stretching electrodes around the surface of photosensitive drum 5041, bringing a developing sleeve having a developer layer close to the surface of photosensitive drum 5041, spacing developing gap 0.4 mm, which is the same developing gap as in a production machine, and applying a voltage of 400 V at a rest state. At the time, measuring an electric current carried though the photosensitive drum. It is noted that since a production machine is used in this measurement, a diameter of photosensitive drum 5041 is 30 mm, and a diameter of developing sleeve 650 is 18 mm. In addition, an amount of developer on developing sleeve 650 is 430 $g/m^2$, whereby a weight of developer per 1 square meter is 430 g.

In an area adjacent to a surface of photosensitive drum 5041 and developing sleeve 650 (hereinafter referred to as nip area), the developer layer is pressed, and an electric current is carried from outer circumferential surface 650S, thus an electrical resistance of developer can be calculated regardless of an electrical resistance of groove 651.

Here, a period from a instant when application of a predetermined voltage to developing sleeve 650 is started is referred to a time constant: namely, to a time when an original voltage between developing sleeve 650 and a magnet brush formed and held on developing sleeve 650 reaches a target voltage, which voltage is a direct voltage of the original voltage multiplied by a specified rate. The time constant is determined by an electrical resistance, an electrostatic capacity and a particle shape of a carrier. If the direct voltage of the developing bias voltage is −600 V as described above, a time constant that is a period during which a voltage of a magnetic brush reaches −480V that is 80% of the direct voltage is 2 msec. It is to be noted here that "1 msec" means a thousandth of a second.

When a magnetic brush extends from groove 651, an electric charge is hardly carried because an electrical resistance of material of groove 651 is higher than that of the carrier, as described above. Therefore, a time constant of a magnetic brush extended from groove 651 has a greater value than a time constant of a magnetic brush extended from outer circumferential surface 650S. Accordingly, for a magnetic brush extending from groove 651, a longer period of time is required for a voltage of the pointed end to reach the predetermined voltage, as compared with a voltage of the magnetic brush extending from outer circumferential surface 650S. In other words, when a voltage is applied to developing sleeve 650, a voltage to be applied to a developer held on outer circumferential surface 650S other than groove 651 changes faster than a voltage applied to developer held on groove 651.

2. Operation

Figure 6:
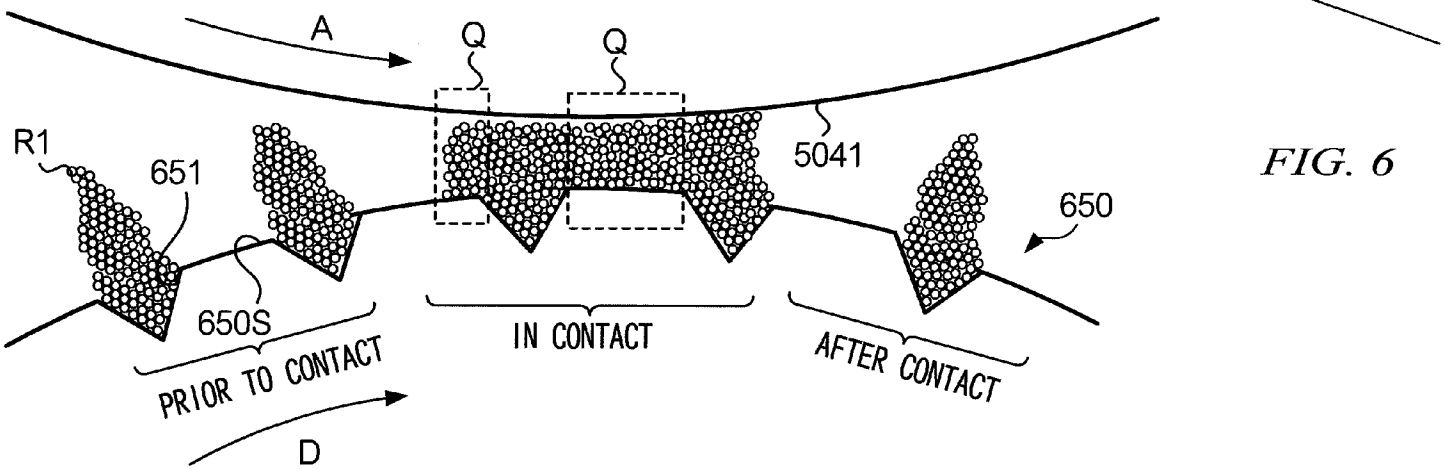
FIG. 6 is a diagram describing an operation when toner is supplied from the developing sleeve to a photosensitive drum.

FIG. 6 is a diagram describing an operation of image-forming apparatus 100 when toner is supplied from developing sleeve 650 to photosensitive drum 5041. As shown in FIG. 6, photosensitive drum 5041 rotates in the direction indicated by a direction of arrow A at a drum surface speed of 240 mm/s, and developing sleeve 650 rotates in the direction indicated by arrow D at a sleeve surface speed of 600 mm/s. Gathered developer R1 shown in FIG. 6 is a magnetic brush. The magnetic brush is held on the surface of developing sleeve 650, and an amount of developer carried is adjusted by developer doctor 73. Outer circumferential surface 650S of developing sleeve 650 other than groove 651 is smoother than the inner wall surface of groove 651, thus a frictional force acting between developer and outer circumferential surface 650S is relatively small; and as a result of which developer becomes slippery under rotation of developing sleeve 650, whereby it becomes difficult for a magnetic brush be built up on outer circumferential surface 650S. On the other hand, a normal vector of upstream inner wall surface 651A has a direction that is the same as that of a direction of rotation of developing sleeve 650, which is a directional component. Developer held on upstream inner wall surface 651A rotates in the direction indicated by arrow D in FIG. 6, while receiving drag along the normal vector, thus the developer tends to stop near the inner wall surface of groove 651. In other words, a magnetic brush easily glows on upstream inner wall surface 651A. As a result, a magnetic brush generally grows from groove 651 while extending in a radial direction of developing sleeve 650 in an area prior to contact of the magnetic brush with photosensitive drum 5041 (hereinafter referred to as pre-contact area), as shown in FIG. 6.

Material M1 of groove 651 has an electrical resistance that is higher than that of a carrier of developer. Thus, a time constant of a magnetic brush grown on groove 651 is great, and a voltage change in a radial direction of developing sleeve 650 is slower than that of a magnetic brush grown on outer circumferential surface 650S. Accordingly, it is possible to prevent a coulomb force acting from an image-forming unit of photosensitive drum 5041 on a magnetic brush grown on groove 651 in the pre-contact area. As a result, a phenomenon known as beads carry over (BCO), in which carrier flows toward photosensitive drum 5041, hardly occurs in the pre-contact area.

On the other hand, in an area where a magnetic brush contacts photosensitive drum 5041, the magnetic brush collapses, and the developer becomes dense. In consequence, developer contacts outer circumferential surface 650S of developing sleeve 650, as shown in area Q of FIG. 6. Material M0 of outer circumferential surface 650S has an electrical resistance lower than that of the carrier of developer, as described above, and a time constant of a magnetic brush extending from outer circumferential surface 650S is much smaller than a time constant of a magnetic brush extending from groove 651, as described above. Therefore, a voltage of the pointing end of a magnetic brush in contact with photosensitive drum 5041 reaches the predetermined voltage more rapidly than prior to contacting photosensitive drum 5041.

Subsequently, the magnetic brush is separated from photosensitive drum 5041. However, a voltage of the magnetic brush is subject to a rapid change while in contact with photosensitive drum 5041. For example, when a time constant of a magnetic brush extended from outer circumferential surface 650S is 2 msec, sleeve surface speed is 600 mm/s, as described above, 80% of the developing bias voltage is applied to the pointing end of a magnetic brush extending from outer circumferential surface 650S, while developing sleeve 650 rotationally moves by 1.2 mm. The diameter of developing sleeve 650 is 18 mm, the outer circumference is about 57 mm, thus the distance 1.2 mm is only 2% of the outer circumference of developing sleeve 650. For this reason, a magnetic brush immediately after separation from photosensitive drum 5041 has a voltage close to the developing bias voltage, even if the magnetic brush extends from groove 651.

When toner added to carrier moves to photosensitive drum 5041, a so-called counter charge may be generated at a carrier, and the carrier may have an opposite charge to the toner. If the counter charge occurs at a magnetic brush after contact, so-called "starvation" occurs, in which toner moved to photosensitive drum 5041 is drawn and returned under the generated counter charge, and an image formed on an image holder may thereby affected deleteriously such that a part of the image is not visible and appears white. As described above, a voltage of a magnetic brush after contact is close to the developing bias voltage, and generation of a counter charge hardly occurs at a magnetic brush after contact. Accordingly, a risk of damage to an image formed on an image holder is decreased.

3. Modification

The foregoing is a description of an exemplary embodiment. This exemplary embodiment may be modified as described below. In addition, modified examples described below may also be used in a variety of combinations.

(1) In the above exemplary embodiment, groove 651 provided at developing sleeve 650 has V-shape as viewed in cross section, but a shape of the groove is not limited to this aspect. For example, the groove may have a rectangular or trapezoid shape as viewed in cross section.

(2) In the above exemplary embodiment, the inner wall surface of groove 651 provided at developing sleeve 650 is formed from material M1 having an electrical resistance higher than that of a carrier of developer. However every part along a direction from the inner wall surface of groove 651 provided at developing sleeve 650 to central axis 650C may be formed from material M1. In general, material M1 is used for a part located where electricity flows to developer held on the inner wall surface of groove 651.

(3) In the above exemplary embodiment, a method of producing developing sleeve 650 is not described, but developing sleeve 650 may be formed by providing on its surface an aluminous anodizing film followed by rotating and grinding by use of centerless grinding. By use of such a method, a chemically stable developer holder can be produced at relatively low cost. In addition, if the anodizing film formed on groove 651 is not ground, and only an anodizing film formed on outer circumferential surface 650S is ground, it is possible to product a developer holder such that respective conductivities differ from each other.

It is noted that if developing sleeve 650 is produced by such a method, the same resistance layer has formed on each of outer circumferential surface 650S and groove 651 before a process in which outer circumferential surface 650S is ground and a conduction layer is left unshrouded. If the above voltage is applied in this step, an electrical resistance of groove 651 can be calculated.

(4) In the above exemplary embodiment, an electrical resistance of carrier of developer is smaller than or equal to $10^8$ ohm, but an electrical resistance of carrier may be higher than $10^8$ ohm. However, to reduce an electric power required for the applied voltage, and to prevent damage to an image by addition of carrier or the like, it is preferred that an electrical resistance of carrier is smaller than or equal to $10^8$ ohm.

(5) In the above exemplary embodiment, the materials are selected such that an electrical resistance of material M0 used for outer circumferential surface 650S is lower than an electrical resistance of carrier of developer, and an electrical resistance of material M1 used for an inner wall surface of groove 651 is higher than the electrical resistance of carrier of developer. However it is only necessary that the electrical resistance of material M0 be lower than at least the electrical resistance of material M1 since, when a voltage is applied to developing sleeve 650, a voltage to be applied to developer held on outer circumferential surface 650S other than groove 651 changes faster than a voltage to be applied to developer held on groove 651. Altogether, an electrical resistance of the surface of a developer holder other than an inner wall surface of grooves is lower than an electrical resistance of the inner wall surface of the grooves.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiments have been chosen and described to best explain the principles of the invention and its practical applications, thereby enabling others skilled in the art to understand the invention for use with various embodiments and with various modifications as suited to a particular use contemplated. It is intended that the scope of the invention be defined by the following claims and their equivalents.

What is claimed is:

1. A developing device comprising:

a magnetic field generating unit that generates a magnetic field; and a cylindrical developer holder, to which a voltage is applied, that surrounds the magnetic field generating unit and rotates, the cylindrical developer holder:

having an outer circumferential surface having a plurality of grooves that extend in a direction of a rotational axis, the outer circumferential surface being capable of holding developer including a magnetic substance by using the magnetic field generated by the magnetic field generation unit, an electrical resistance of an inner wall surface of each of the grooves being higher than an electrical resistance of the magnetic substance included in the developer; and supplying the developer to an image holder that holds an electrostatic latent image, wherein an anodizing film is formed on the inner wall surface, and the anodizing film is not formed on a surface of a part of the developer holder other than the plurality of grooves.

2. The developing device according to claim 1, wherein a surface of a part of the developer holder other than the plurality of grooves is smoother than the inner wall surface of each of the grooves.

3. The developing device according to claim 2, wherein when the voltage is applied to the developer holder, a voltage to be applied to developer held on the part other than the plurality of grooves changes faster than a voltage to be applied to developer held on each of the grooves.

4. The developing device according to claim 2, wherein an electrical resistance of a surface of the part of the developer holder other than the plurality of grooves is lower than the electrical resistance of the inner wall surface of each of the grooves.

5. The developing device according to claim 1, wherein when a voltage is applied to the developer holder, the voltage to be applied to developer held on a part other than the plurality of grooves changes faster than a voltage to be applied to developer held on each of the grooves.

6. The developing device according to claim 5, wherein an electrical resistance of a surface of the part of the developer holder other than the plurality of grooves is lower than the electrical resistance of the inner wall surface of each of the grooves.

7. The developing device according to claim 1, wherein an electrical resistance of a surface of a part of the developer holder other than the plurality of grooves is lower than the electrical resistance of the inner wall surface of each of the grooves.

8. The developing device according to claim 1, wherein:

the developer includes a toner and a carrier;

the electrical resistance of the inner wall surface of each of the grooves is higher than an electrical resistance of the carrier included in the developer, and an electrical resistance of a surface of a part of the developer holder other than the plurality of grooves is lower than the electrical resistance of the carrier included in the developer.

9. The developing device according to claim 1, wherein the developer of the developing device includes a toner and a carrier, and an electrical resistance of the carrier is greater than $10^8$ ohms.

10. The developing device according to claim 1, wherein:

the developer forms a magnetic brush extending from each of the grooves; and the magnetic brush collapses and contacts the outer circumferential surface of the developing device in an area where the magnetic brush contacts the image holder.

11. An image-forming apparatus comprising;

an image holder that holds an electrostatic latent image;

a developing device that includes:

a magnetic field generating unit that generates a magnetic field; and a cylindrical developer holder, to which a voltage is applied, that surrounds the magnetic field generating unit and rotates, the cylindrical developer holder:

having an outer circumferential surface having a plurality of grooves that extend in a direction of a rotational axis, the outer circumferential surface being capable of holding developer including a magnetic substance by using the magnetic field generated by the magnetic field generation unit, an electrical resistance of an inner wall surface of each of the grooves being higher than an electrical resistance of the magnetic substance included in the developer; and supplying the developer to the image holder; and a transfer unit that transfers from the image holder to a recording medium an image developed with the developer supplied from the developing device, wherein an anodizing film is formed on the inner wall surface, and the anodizing film is not formed on a surface of a part of the developer holder other than the plurality of grooves.

12. The image-forming apparatus according to claim 11, wherein a surface of a part of the developer holder other than the plurality of grooves is smoother than the inner wall surface of each of the grooves.

13. The image-forming apparatus according to claim 11, wherein when the voltage is applied to the developer holder, a voltage to be applied to developer held on a part other than the plurality of grooves changes faster than a voltage to be applied to developer held on each of the grooves.

14. The image-forming apparatus according to claim 11, wherein an electrical resistance of a surface of a part of the developer holder other than the plurality of grooves is lower than the electrical resistance of the inner wall surface of each of the grooves.

15. The image-forming apparatus according to claim 11, wherein:

the developer includes a toner and a carrier;

the electrical resistance of the inner wall surface of each of the grooves is higher than an electrical resistance of the carrier included in the developer, and an electrical resistance of a surface of a part of the developer holder other than the plurality of grooves is lower than the electrical resistance of the carrier included in the developer.

16. The image-forming apparatus according to claim 11, wherein the developer of the developing device includes a toner and a carrier, and an electrical resistance of the carrier is greater than $10^8$ ohms.

17. The image-forming apparatus according to claim 11, wherein:

the developer forms a magnetic brush extending from each of the grooves; and the magnetic brush collapses and contacts the outer circumferential surface of the developing device in an area where the magnetic brush contacts the image holder.

* * * * *